US006596672B1

(12) United States Patent
Carrick et al.

(10) Patent No.: US 6,596,672 B1
(45) Date of Patent: Jul. 22, 2003

(54) LOW ASH LUBRICANT COMPOSITIONS CONTAINING MULTIPLE OVERBASED MATERIALS AND MULTIPLE ANTIOXIDANTS

(75) Inventors: Virginia A. Carrick, Chardon, OH (US); Ewa A. Bardasz, Mentor, OH (US); David E. Ripple, Kirtland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/156,593

(22) Filed: May 28, 2002

Related U.S. Application Data

(63) Continuation of application No. 08/720,583, filed on Oct. 2, 1996, now abandoned, which is a continuation of application No. 08/382,457, filed on Feb. 1, 1995, now abandoned.

(51) Int. Cl.[7] ..... C10M 141/00

(52) U.S. Cl. ..... 508/192; 508/293; 508/398; 508/460; 508/542; 508/563; 508/584; 508/585; 508/435

(58) Field of Search ..... 508/192, 398, 508/460, 435

(56) References Cited

U.S. PATENT DOCUMENTS 4,867,890 A 9/1989 Colclough et al. ..... 252/327 E
5,102,566 A * 4/1992 Fetterman, Jr. et al. . 252/32.7 E

* cited by examiner

*Primary Examiner*—Ellen M. McAvoy
(74) *Attorney, Agent, or Firm*—David M. Shold; Michael F. Esposito

(57) ABSTRACT

A low sulfate ash lubricating oil composition comprising an oil of lubricating viscosity, 0.1 to 3.0% of a calcium overbased acidic material, 0.1 to 2.0% of a magnesium overbased acidic material, and at least 0.5% of a combination of an alkylene-coupled hindered phenol antioxidant and an antioxidant other than an alkylene-coupled hindered phenol antioxidant, is particularly useful for lubricating stationary gas engines.

12 Claims, No Drawings

LOW ASH LUBRICANT COMPOSITIONS CONTAINING MULTIPLE OVERBASED MATERIALS AND MULTIPLE ANTIOXIDANTS

This application is a continuation of Ser. No. 08/720,503 filed Oct. 2,1996 now abandoned, which is a continuation of Ser. No. 08/382,457 filed Feb. 1, 1995 now abandoned.

BACKGROUND OF THE INVENTION

The present invention relates to lubricating oil compositions and concentrates therefore which provide low sulfated ash while maintaining high performance standards.

There is continuous need for improving the performance characteristics of gasoline and diesel engines, stationary gas engines, and the lubricating oils used therein. For example, modern diesel engines are sometimes fitted with a particulate trap to minimize the amount of particulates which are emitted to the atmosphere as pollution. Such particulates may include soot from incomplete combustion but also include ash of various types, much of which is non-volatile metal compounds originating from metal-containing additives in the fuel or, especially, in the lubricant. Excessive ash buildup in particulate traps is a concern because certain types of metal-containing ash are not readily removed from the trap, thus making the regeneration and reuse of such traps difficult if not impossible. Likewise, stationary gas engines (typically large, heavy duty, stationary engines designed to run on natural gas and other like fuels) are facing changes. Trends in such engines include the development of smaller four-cycle, lean burning engines, for which low ash, high performance lubricants are important.

Despite the drawbacks from the use of metal compounds in lubricants, additives, including metal-containing additives, have been used for many years and will likely continue to be used for many years in the future. This is because metal-containing additives perform essential functions in motor oils and other lubricants. Certain metal salts are detergents, which serve to neutralize acidic combustion products which make their way into motor oil. Others are dispersants or antiwear agents. To simply reduce or eliminate the amount of metal-containing additives from a motor oil would lead to failure of the oil in many industry-mandated performance tests.

There are industrial performance criteria which must be met for a variety of lubricant applications. Among the most important are those for diesel engines, gasoline engines, stationary gas engines, and marine diesel engines. A useful lubricating oil will be able to pass the tests for one or more types of engines.

There has been a great deal of research reported on various lubricant formulations to solve specific problems. For example, U.S. Pat. No. 5,259,967, Ripple, Nov. 9, 1993, discloses a lubricating oil composition providing less than 1% sulfated ash, comprising an additive package of a carboxylic dispersant, a rust inhibiting mixture, a hydrocarbyl substituted phenol, and a neutralized acid or phenol.

U.S. Pat. Nos. 5,102,566 and 5,320,765, Fetterman, Jr., et al., Apr. 7, 1992 and Jun. 14, 1994, disclose low sulfated ash lubricating oil compositions for, e.g., natural gas fueled engines. The additives include at least about 2 wt. % of at least one ashless nitrogen- or ester-containing dispersant, an antioxidant, and at least one oil soluble dihydrocarbyl dithiophosphate antiwear material. Other materials which can be present include metal detergent inhibitors such as mixtures of Ca and Mg salts of one or more organic sulfonic acids. The antioxidant can be a variety of materials including 4,4'-methylenebis(2,6-di-tert-butylphenol). Examples include compositions of PIBSA-PAM dispersant, sulfurized nonyl phenol, zinc dialkyl dithiophosphate, overbased Mg sulfonate detergent inhibitor, VI improver, and base oil, ash being about 0.5.

U.S. Pat. No. 5,326,485, Cervenka et al., Jul. 5, 1994, discloses low ash lubricating oil compositions, employing certain specified types of zinc dialkyl dithiophosphates in combination with certain types of auxiliary additive components, including an oil-soluble hindered phenolic antioxidant or an aromatic secondary amine or a combination of them, and an overbased alkaline earth metal sulfurized alkyl phenate or alkyl aromatic sulfonate or a combination of them. Ca, Mg, Sr, or Ba materials can be used.

U.S. Pat. No. 4,528,108, Grover, Jul. 9, 1985, discloses a coolant fluid composition comprising a lubricating oil and one or more basic metal salts of organic acids, one or more phosphorus-containing metal salts, and one or more phenol antioxidants. Salts containing a mixture of ions of two or more metals can be used.

U.S. Pat. No. 5,164,102, Everett et al., Nov. 17, 1992, discloses motor oil containing a combination of (i) an overbased alkaline earth metal sulfonate, (ii) a zinc dihydrocarbyl dithiophosphate and other components. The composition can contain an ashless dispersant selected from polyolefin-substituted succinamides or imides of polyethylene polyamines and certain boronated materials.

U.S. Pat. No. 4,647,287, Muir, Mar. 3, 1987, discloses a lubricating oil containing a succinic anhydride promoter reaction product for an overbased magnesium sulfonate. Copromoters such as a salicylic acid may be employed.

U.S. Pat. No. 4,617,135, Muir, Oct. 14, 1986, discloses a process for the preparation of overbased magnesium sulfonates which includes the use of a sulfonic acid or salt thereof and e.g. a hydroxyaromatic carboxylic acid.

U.S. Pat. No. 3,385,791, Colyer et al., May 28, 1968, discloses a lubricant oil composition containing oil-soluble nitrogen- and boron-containing dispersant detergent, oil soluble calcium or magnesium sulfonate of high alkalinity, and oil-soluble zinc dialkyldithiophosphates. Sulfated ash of the compositions in the examples is 1.0%.

U.S. Pat. No. 4,981,603, Demange, Jan. 1, 1991, discloses a method for preparing lubricating oil additive concentrates in which dispersant and overbased detergent have improved compatibility. The detergent is a basic magnesium-containing detergent. Dispersants are selected from, nitrogen containing ashless dispersants such as succinimide dispersants. The succinimide can be post treated with boron.

U.S. Pat. No. 3,254,025, Le Suer, May 31, 1966, discloses lubricating compositions containing boron-containing acylated amines. Other additives include ash-containing detergents.

U.S. Pat. No. 2,944,970, Peterson, Jul. 12, 1960, discloses grease compositions containing salicylic acid derivatives.

U.S. Pat. No. 4,088,587, Lowe, May 9, 1978, discloses lubricating oil additive compositions including an antioxidant selected from oil-soluble sterically hindered phenols or thio phenols, succinimide dispersants, etc. Lubricants can be used in a natural gas engine.

There has now been found a lubricating oil composition which is significantly reduced in ash-forming additives but which still meets demanding performance requirements for a variety of engines, and, in particular, stationary gas engines.

SUMMARY OF THE INVENTION

The present invention provides a composition comprising: (a) a major amount of an oil of lubricating viscosity; (b) a calcium, barium, or strontium overbased acidic material in an amount to contribute 0.01 to 0.79 percent sulfated ash; (c) a magnesium or sodium overbased acidic material in an amount to contribute 0.01 to 0.79 percent sulfated ash; (d) about 0.1 to about 1.5 percent by weight of an alkylene-coupled hindered phenol antioxidant; (e) about 0.1 to about 6 percent by weight of at least one antioxidant other than an alkylene-coupled hindered phenol antioxidant; provided that components (d) and (e) together comprise at least about 0.5 percent by weight of the composition; and (f) at least about 0.2 percent by weight of a dispersant; further provided that the composition has a total sulfated ash content of about 0.1 percent to about 0.8 percent.

The invention further provides a composition comprising (a) a concentrate-forming amount of an oil of lubricating viscosity; (b) a calcium, barium, or strontium overbased acidic material; (c) a magnesium or sodium overbased acidic material; (d) about 1 to about 15 parts by weight of an alkylene-coupled hindered phenol antioxidant; (e) about 1 to about 60 parts by weight of at least one antioxidant other than an alkylene-coupled hindered phenol antioxidant; provided that components (d) and (e) together comprise at least about 5 parts by weight; and (f) at least about 2 parts by weight of a dispersant; provided that the composition has a metal content suitable to provide a total sulfated ash of about 0.1 percent to about 0.8 percent, 0.01 to 0.79 percent sulfated ash being contributed by the material of (b) and 0.01 to 0.79 percent being contributed by the material of (c), when the composition is diluted in a way that components (b), (c), (d), and (e) together comprise 3.5 percent by weight of the diluted composition.

The present invention further provides a method for lubricating a gas-powered internal combustion engine, comprising supplying to the engine the above-described lubricating composition.

DETAILED DESCRIPTION OF THE INVENTION

The first component of the present invention is an oil of lubricating viscosity, including natural or synthetic lubricating oils and mixtures thereof. Natural oils include animal oils, vegetable oils, mineral lubricating oils of paraffinic, naphthenic, or mixed types, solvent or acid treated mineral oils, and oils derived from coal or shale. Synthetic lubricating oils include hydrocarbon oils, halo-substituted hydrocarbon oils, alkylene oxide polymers (including those made by polymerization of ethylene oxide or propylene oxide), esters of dicarboxylic acids and a variety of alcohols including polyols, esters of phosphorus-containing acids, polymeric tetrahydrofurans, and silicon-based oils (including siloxane oils and silicate oils). Included are unrefined, refined, and rerefined oils. Specific examples of the oils of lubricating viscosity are described in U.S. Pat. No. 4,326,972.

The of lubricating oil in the invention will normally comprise the major amount of the composition. Thus it will normally be at least 50% by weight of the composition, preferably 76 to 99%, more preferably 90 to 97%, and most preferably 92 to 96%. As an alternative embodiment, however, the present invention can provide an additive concentrate in which the oil can be up to 50% by weight, i.e., 1 to 50%, preferably 3 to 30% and more preferably 5 to 20%. The concentrate embodiment is described in more detail below.

Other important components of the invention include overbased acid materials, in particular, combinations of calcium, barium, or strontium overbased materials with magnesium or sodium overbased materials. Overbasing, also referred to as superbasing or hyperbasing, is a means for supplying a large quantity of basic material in a form which is soluble or dispersible in oil. Overbased products have been long used in lubricant technology to provide detergent additives.

Overbased materials are generally single phase, homogeneous systems characterized by a metal content in excess of that which would be present according to the stoichiometry of the metal and the particular acidic organic compound reacted with the metal. The amount of excess metal is commonly expressed in terms of metal ratio. The metal ratio is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of greater than 1, i.e., at least 1.1, preferably at least 1.5, more preferably 3, and more preferably 7, up to 40, preferably 25, and more preferably 20.

The extent of metal incorporation into the overbased material can also be expressed in terms of base number. Base number, or total base number, is the amount of acid (perchloric or hydrochloric) needed to neutralize all of the overbased material's basicity. The amount of acid is expressed as potassium hydroxide equivalents. Total base number is determined by titration of one gram of overbased material with 0.1 Normal hydrochloric acid solution using bromophenol blue as an indicator. The overbased materials of the present invention generally, when they are present in their customary form, generally are present with approximately equal amounts of diluent oil, typically about 60% by weight active chemical and about 40% diluent oil. Thus the overbased materials, when recalculated on the basis of active chemical, would generally have a total base number of at least 33, preferably at least 83, and more preferably at least 167, and up to 1000, preferably 830, and more preferably 670. Corresponding amounts calculated on the basis of the conventional, oil-containing compositions, are about 20, 50, 100, and 600, 500, 400.

The overbased materials are prepared by reacting an acidic organic compound, a reaction medium comprising at least one inert, organic solvent (mineral oil, naphtha, toluene, xylene, etc.) for said acidic organic material, and a stoichiometric excess of a metal base, generally in the presence of a low molecular weight acid, such as an acidic gas, and a promoter.

The acidic organic compounds useful in making the overbased compositions of the present invention include carboxylic acids, sulfonic acids, phosphorus-containing acids, phenols or mixtures of two or more thereof. (Any reference to acids, such as carboxylic, or sulfonic acids, is intended to include the acid-producing derivatives thereof such as anhydrides, lower alkyl esters, acyl halides, lactones and mixtures thereof unless otherwise specifically stated.)

The carboxylic acids useful in making the overbased salts of the invention may be aliphatic or aromatic, mono- or polycarboxylic acid or acid-producing compounds. These carboxylic acids include lower molecular weight carboxylic acids (e.g., carboxylic acids having up to about 22 carbon atoms such as acids having 4 to 22 carbon atoms or tetrapropenyl-substituted succinic anhydride) as well as higher molecular weight carboxylic acids.

The carboxylic acids of this invention are preferably oil-soluble. Usually, in order to provide the desired oil-solubility, the number of carbon atoms in the carboxylic acid should be at least 8, more preferably at least 18, more preferably at least 30, more preferably at least 50. Generally, these carboxylic acids do not contain more than 400 carbon atoms per molecule.

The lower molecular weight monocarboxylic acids contemplated for use in this invention include saturated and unsaturated acids. Examples of such useful acids include dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene ($M_n$=200–1500), polypropenyl-substituted succinic acid derived from a polypropene, ($M_n$=200–1000), octadecyl-substituted adipic acid, chlorostearic acid, 9-methyl-stearic acid, dichlorostearic acid, stearyl-benzoic acid, eicosanyl-substituted naphthoic acid, dilauryl-decahydronaphthalene carboxylic acid, mixtures of any of these acids, their alkali and alkaline earth metal salts, and/or their anhydrides, etc. A preferred group of aliphatic carboxylic acids includes the saturated and unsaturated higher fatty acids containing from 12 to 30 carbon atoms. Other acids include aromatic carboxylic acids include substituted and non-substituted benzoic, phthalic and salicylic acids or anhydrides, most especially those substituted with a hydrocarbyl group containing 6 to 80 carbon atoms. Examples of suitable substituent groups include butyl, isobutyl, pentyl, octyl, nonyl, dodecyl, and substituents derived from the above-described polyalkenes such as polyethylenes, polypropylenes, polyisobutylenes, ethylene-propylene copolymers, oxidized ethylene-propylene copolymers, and the like.

Preferred acidic materials for one aspect of the present invention are salicylic acids having $C_{10}$ to $C_{25}$ alkyl substituents.

Sulfonic acids are also useful in making the overbased salts of the invention and include the sulfonic and thiosulfonic acids. The sulfonic acids include the mono- or polynuclear aromatic or cycloaliphatic compounds. The oil-soluble sulfonates can be represented for the most part by one of the following formulae: $R_2$—T—$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)$+T contains a total of at least 15 carbon atoms; and $R_3$ is an aliphatic hydrocarbyl group containing at least 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above formulas can also contain other inorganic or organic substituents in addition to those enumerated above such as, for example, hydroxy, mercapto, halogen, nitro, amino, nitroso, sulfide, disulfide, etc. In the above formulas, a and b are at least 1.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polybutene having a number average molecular weight (Mn) in the range of 500 to 5000 with chlorosulfonic acid, nitronaphthalene sulfonic acid, paraffin wax sulfonic acid, cetyl-cyclopentane sulfonic acid, lauryl-cyclohexane sulfonic acids, polyethylenyl-substituted sulfonic acids derived from polyethylene ($M_n$= 300–1000), etc. Normally the aliphatic groups will be alkyl and/or alkenyl groups such that the total number of aliphatic carbons is at least 8.

Another group of sulfonic acids are mono-, di-, and tri-alkylated benzene and naphthalene (including hydrogenated forms thereof) sulfonic acids. Such acids include di-isododecyl-benzene sulfonic acid, polybutenyl-substituted sulfonic acid, polypropylenyl-substituted sulfonic acids derived from polypropene having an $M_n$=300–1000, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, stearylnaphthalene sulfonic acid, and the like.

Preferred acids for the overbased materials for one aspect of the present invention include the materials known as synthetic sulfonic acids. These include alkyl-substituted benzenesulfonic acids having a (number average) molecular weight of 300 to 600.

Specific examples of oil-soluble sulfonic acids are mahogany sulfonic acids; bright stock sulfonic acids; sulfonic acids derived from lubricating oil fractions having a Saybolt viscosity from 100 seconds at 38° C. (100° F.) to 200 seconds at 99° C. (210° F.); petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids (the material leftover after the removal of dodecyl benzene sulfonic acids that are used for household detergents). The production of sulfonates from detergent manufactured by-products by reaction with, e.g., $SO_3$, is well known to those skilled in the art.

Phosphorus-containing acids are also useful in making the basic metal salts of the present invention and include any phosphorus acids such as phosphoric acid or esters; and thiophosphorus acids or esters, including mono and dithiophosphorus acids or esters. Preferably, the phosphorus acids or esters contain, at least one, preferably two, hydrocarbyl groups containing from 1 to 50 carbon atoms. The phosphorus-containing acids useful in the present invention are described in U.S. Pat. No. 3,232,883 issued to Le Suer.

The phenols useful in making the basic metal salts of the invention are generally represented by the formula $(R_1)_a$—Ar—$(OH)_b$, wherein $R_1$ is a hydrocarbyl group as defined above; Ar is an aromatic group; a and b are independently numbers of at least one, the sum of a and b being in the range of two up to the number of displaceable hydrogens on the aromatic nucleus or nuclei of Ar. $R_1$ and a are preferably such that there is an average of at least 8 aliphatic carbon atoms provided by the $R_1$ groups for each phenol compound. The aromatic group as represented by "Ar" can be mononuclear such as a phenyl, a pyridyl, or a thienyl, or polynuclear.

The metal compounds useful in making basic metal salts are generally any metals, but for the present invention it is desired that there be one component which is a calcium, barium, or strontium overbased acidic material and a second component which is a magnesium or sodium overbased acidic material. Preferably the first component is a calcium material and the second is a magnesium material. Generally the metal compounds are delivered as metal salts. The anionic portion of the salt can be hydroxyl, oxide, carbonate, borate, nitrate, etc. The amount of the calcium, barium or strontium overbased acidic material is typically 0.1 to 3.0 percent by weight of the overall composition; in one preferred embodiment 0.25 to 0.6 percent, and in another preferred embodiment 0.5 to 2 percent. The amount of the magnesium or sodium overbased material is typically 0.1 to 2.0 percent by weight of the overall composition, preferably 0.4 to 1.0 percent.

A low molecular weight acidic material is often used to aid the formation of the basic metal salt. The acidic material may be a liquid such as formic acid, acetic acid, nitric acid, sulfuric acid, etc. Acetic acid is particularly useful. Inorganic gaseous acidic materials may also be used such as HCl, $SO_2$, $SO_3$, $CO_2$, $H_2S$, etc., preferably $CO_2$. A preferred acidic materials is carbon dioxide. When carbon dioxide is used, the material is often referred to as a carbonate overbased material.

A promoter is a chemical employed to facilitate the incorporation of metal into the basic metal compositions. Among the chemicals useful as promoters are water, ammonium hydroxide, organic acids of up to 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to 30 carbon atoms. Examples of the alcohols include methanol, ethanol, isopropanol, dodecanol, behenyl alcohol, ethylene glycol, monomethyl ether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to 10 carbon atoms and mixtures of methanol with higher monohydric alcohols.

Patents specifically describing techniques for making basic salts of the above-described acids include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In one preferred embodiment of the present invention, the composition contains a combination of overbased materials including, first, a carbonated calcium salt of a sulfonic acid, in particular synthetic sulfonic acids. These include alkyl-substituted benzenesulfonic acids having a (number average) molecular weight of 300 to 600. The calcium overbased material can have a total base number of 200 to 400 as conventionally expressed, or, when expressed on the basis of active (oil-free) chemical, about 330 to about 670. The amount of this calcium overbased material can be 0.25 to 0.6 percent by weight of the composition (again, on an oil-free basis). Secondly, in this first preferred embodiment, an overbased magnesium salt will also be present, in an amount of 0.4 to 1.0 percent by weight (oil free) of the composition. The overbased magnesium salt will typically be a carbonated overbased salt of a synthetic sulfonic acid of the type described immediately above; the salt will preferably have a total base number of 50 to 400 as conventionally expressed, or about 70 to about 660, on an oil-free basis, preferably 70–140 (conventional) or about 120–230 (oil free).

In another preferred embodiment, the composition contains a combination of overbased materials including, first, a carbonated calcium salt of a salicylic acid, in particular an alkyl substituted salicylic acid where the alkyl chain or chains contain 10 to 25 carbon atoms. The calcium overbased material can have a total base number of 50 to 400, preferably 100 to 200 as conventionally expressed, or, when expressed on the basis of active (oil-free) chemical, about 83 to about 670, preferably about 170 to about 330. The amount of this calcium overbased material can be 0.5 to 2 percent by weight (oil free basis). Secondly, in this second preferred embodiment, an overbased magnesium salt will also be present, in an amount of 0.4 to 1 percent by weight. The overbased magnesium salt will typically be a carbonated overbased salt of a synthetic sulfonic acid of the type described above; the salt will preferably have a total base number of 50 to 400 as conventionally expressed, or about 70 to about 660 on an oil-free basis, preferably 70–140 (conventional) or about 120–230 (oil free).

While in some instances it may be preferred to provide one overbased metal material with one particular anion and a second with a different anion, this is generally not a strict requirement. For example, while one might supply a calcium carbonate overbased salicylate and a magnesium carbonate overbased sulfonate, such a composition may be equivalent to that obtained by supplying overbased calcium sulfonate and a magnesium overbased salicylate. This is because it is believed that such materials can equilibrate and exchange ions in situ. It is considered to be often more important to provide an appropriate amount of the particular metal ions in question than the identity of a particular anion associated therewith. However, for matters of convenience, ease of synthesis, or, in some cases, improved performance, selection of a particular acid to finction as the anion can be significant.

The amount of the overbased acidic materials present in the composition should be such that the total sulfated ash content of the composition is 0.1 percent to 0.8 percent, preferably less than 0.6 percent, more preferably 0.3 to 0.5 percent, and most preferably about 0.4 weight percent or less. Sulfated ash is a well-defined term, known to those skilled in the art and described in detail in ASTM D-874-92. Sulfated ash is a measurement which corresponds to the sum of all the metals which are present in the lubricating composition. The limited amount of sulfated ash in the present invention directly corresponds to a limited amount of total metals, which limits can be readily calculated by one skilled in the art, with reference to the examples contained herein.

Commercial lubricating oils customarily contain more than one source of metal. For instance, they may contain neutral and overbased metal salts of organic acids or phenols, which may function as dispersants or antioxidants. They may also contain salts, particularly zinc salts, of alkyl phosphorodithioic acids, described below. The requirement of the present invention that the sulfated ash be up to 0.8%, and preferably well under 0.8%, requires that the total contribution from all the metals be maintained at these levels. For example, a customary lubricant composition may contains 1% sulfated ash, which represents the sum of 0.2% zinc ash from a zinc alkyl phosphorodithioate and 0.8% calcium or magnesium ash from overbased acids. A reduction of this ash level to the preferred level of about 0.4% might be accomplished by the proportional reduction of both the zinc and the calcium or magnesium (or other metal) levels. However, it may well be desirable that the amount of zinc alkyl phosphorodithioate remain relatively unchanged, in order to retain the functional benefits of this material as an additive. In that case the amount of overbased acids would need to be reduced from the original level by a correspondingly greater amount. It is unexpected that such a significant reduction could still provide a lubricant which gives protection to machinery and engines, but this is what has been found when the compositions of the present invention are employed.

The compositions of the present invention also include at least two antioxidants, in a total amount of at least 0.5 percent by weight of the composition. One such antioxidant is an alkylene coupled hindered phenol antioxidant. This material will be present in an amount of 0.1 to 1.5 percent by weight of the lubricant composition, preferably 0.25 to 0.6 percent by weight. This material can be a reaction product of a hydrocarbyl-substituted phenol and an aldehyde such as acetaldehyde or, preferably, formaldehyde. The reaction product is often a mixture of chemical species, generally involving two phenols bridged by an alkylene (preferably methylene) group ortho to the phenolic OH group. Depending on reaction conditions, however, three or even more aromatic rings can be linked by bridging methylene groups derived from formaldehyde. In one embodiment, this phenolic component is at least partially neutralized by treatment with a basic metallic compound; a calcium salt can be formed by reaction of the bridged phenolic material with calcium oxide or hydroxide. Such materials are described in more detail in U.S. Pat. No. 3,793,201. Briefly, these reaction products include that class of phenols represented by the following general formula:

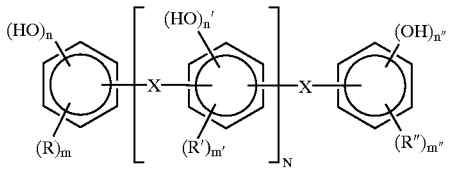

wherein n, n', and n" are each independently integers of 1–3 but preferably 1; R, R', and R" are each independently aliphatic hydrocarbon groups such as alkyl or alkenyl of at least four carbon atoms each and usually six to forty carbon atoms each; m, m', and m" are each independently integers of 0–3 but preferably 1 or 2; N is an integer of 0–10 but usually 0–5; and X is a divalent bridging radical. The divalent bridging radical usually will be a lower alkylene radical of up to about seven carbon atoms, and particularly methylene.

The aliphatic aldehyde used in the formation of these phenolaldehyde condensation products is preferably formaldehyde or an equivalent material such as formalin or paraformaldehyde. Other suitable aldehydes include acetaldehyde, crotonaldehyde, butyraldehyde, propionaldehyde, and the like. Examples of the preparation of the metal salts of phenol-aldehyde condensation products is found in, for example, U.S. Pat. No. 2,647,873.

A preferred antioxidant of this type is para methylene-coupled 2-6-di-t-butylphenol.

In one embodiment of the present invention, the hindered phenolic antioxidant has been prepared without the use of active sulfur- or chlorine containing reagents, in part because of the deleterious effects that sulfur or chlorine contaminants have on the corrosion properties of lubricating oils. Furthermore, such materials, if they are bridged with sulfur atoms rather than alkylene groups, are believed to perform less efficiently, even if there is no contamination by residual elemental sulfur. Thus the materials of this component are preferably not bridged with sulfur atoms, in contrast to the situation with many more common bridged phenols. Rather, they are bridged with the alkylene or preferably methylene groups resulting from reaction of the phenol with the aldehyde, preferably the formaldehyde.

Another component of the mixture is at least one antioxidant other than an alkylene-coupled hindered phenol antioxidant. This second antioxidant component will comprise up to 6 percent by weight of the lubricant composition, and is preferably present in an amount of 0.5 to 2.5 percent by weight, more preferably 1 to 2 percent. This second antioxidant component can comprise a single antioxidant or more than one antioxidant.

Antioxidants comprise a wide class of well-known materials, notably including alkyl-substituted hindered phenols and aromatic amines. It is preferred that the supplemental antioxidant of the present compositions is at least one alkyl-substituted hindered phenol or at least one aromatic amine, or preferably a mixture of these types.

Hindered phenols (other than the bridged phenolic antioxidants described above) are generally alkyl phenols of the formula

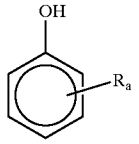

wherein each R is independently an alkyl group containing from 1 up to about 24 carbon atoms and a is an integer of from 1 up to 5. Preferably R contains from 4 to 18 carbon atoms and most preferably from 4 to 12 carbon atoms. R may be either straight chained or branched chained; branched chained is preferred. The preferred value for a is an integer of from 1 to 4 and most preferred is from 1 to 3. An especially preferred value for a is 2.

The hindered phenolic antioxidant is preferably an alkyl phenol; however, mixtures of alkyl phenols may be employed. Preferably the phenol is a butyl substituted phenol containing 2 or 3 t-butyl groups. When a is 2, the t-butyl groups normally occupy the 2,6-position, that is, the phenol is sterically hindered:

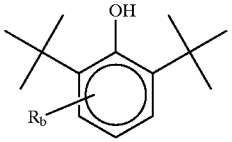

where b is 0 to 3. When a is 3, the t-butyl groups normally occupy the 2,4,6-position. Other substituents are permitted on the aromatic ring. Examples of phenolic antioxidants include 2,6-di-t-butyl-p-cresol (i.e., 2,6-di-t-butyl-4-methylphenol) and other para alkyl substituted di-t-butyl phenols, where the para alkyl group contains 9 to 18 carbon atoms. In one embodiment the alkyl group contains 12 carbon atoms and can be seen as a propylene tetramer. These and other hindered phenolic antioxidants and their methods of preparation are well known to those skilled in the art; such antioxidants are commercially available. Related materials include sulfur-bridged alkyl-substituted phenolic antioxidants; such materials may also be at least partially neutralized with a metal salt. In one embodiment a para-alkyl-substituted hindered phenol antioxidant is present in an amount of 0.4 to 1 percent by weight of the composition.

Aromatic amine antioxidants include aromatic amines of the formula

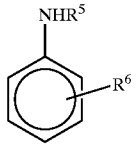

wherein $R^5$ is

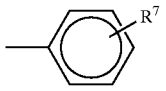

and $R^6$ and $R^7$ are independently a hydrogen or an alkyl group containing from 1 up to 24 carbon atoms. Preferably $R^6$ and $R^7$ are alkyl groups containing from 4 up to about 20 carbon atoms. A particularly useful amine antioxidant is an alkylated diphenylamine such as nonylated diphenylamine of the formula

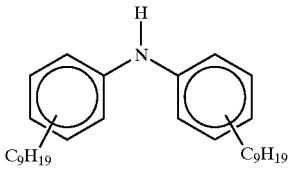

Aromatic amine antioxidants and their preparation are well known to those skilled in the art. These materials are commercially available and are supplied as Naugard™ 4386 by Uniroyal Chemical. Such a diarylamine antioxidant is preferably present in an amount of 0.7 to 1.5 percent by weight.

Other types of antioxidants include alkylated hydroquinones, hydroxylated thiodiphenyl ethers, alkylidene bisphenols, benzyl compounds, acylaminophenols, esters or amides of β-(3,5-di(branched alkyl)-4-hydroxyphenyl)propionic acids, aliphatic or aromatic phosphites, esters of thiodipropionic acid or thiodiacetic acid, and salts of dithiocarbamic or dithiophosphoric acids.

While the foregoing components are considered to be the most important components of the present invention, lubricants often contain other components, and the same may be true of lubricants of the present invention. One additional component is a dispersant, preferably a nitrogen-containing dispersant, present in an amount of at least 0.2 percent by weight, preferably 0.5 to 10 percent by weight, in one embodiment preferably 0.8 to 1.6 percent, and in another embodiment preferably 1.5 to 6 percent by weight.

Nitrogen-containing dispersants normally comprise the reaction product of a hydrocarbyl-substituted succinic anhydride with at least one polyarnine. It is understood that this reaction product need not be prepared from the anhydride itself, but can be prepared by the reaction of any suitable equivalent acylating agent. Such hydrocarbyl-substituted succinic acylating agents include succinic acids, halides, esters, and anhydrides, preferably, acids, esters or anhydrides, more preferably anhydrides. The hydrocarbyl substituent group generally contains an average of at least 8, or 30, or 35 up to 350, or to 200, or to 100 carbon atoms. In one embodiment, the hydrocarbyl group is derived from a polyalkene characterized by an n (number average molecular weight) of at least 500. Generally, the polyalkene is characterized by an n of 500, or 700, or 800, or even 900 up to 5000, or to 2500, or to 2000, or even to 1500.

The polyalkenes include homopolymers and interpolymers of polymerizable olefin monomers of 2 to 16 or 6 or 4 carbon atoms. The olefins may be monoolefins such as ethylene, propylene, 1-butene, isobutene, and 1 -octene; or a polyolefinic monomer, such as diolefinic monomer, such 1,3-butadiene and isoprene. In one embodiment, the interpolymer is a homopolymer, and preferably it is polyisobutylene, and preferably having a number average molecular weight of 500 to 5000. The preparation and use of substituted succinic acylating agents wherein the substituent is derived from such polyalkenes are described in U.S. Pat. No. 4,234,435.

In another embodiment, the succinic acylating agents are prepared by reacting the above described polyalkene with an excess of maleic anhydride to provide substituted succinic acylating agents wherein the number of succinic groups for each equivalent weight of substituent group is at least 1.3, or to 1.5, or to 1.7, or to 1.8. The maximum number generally will not exceed 4.5, or to 2.5, or to 2.1, or to 2.0. The polyalkene may be any of those described above. The preparation and use of substituted succinic acylating agents wherein the substituent is derived from such polyolefins are described in U.S. Pat. No. 4,234,435.

The succinic acylating agents are prepared by reacting the above-described hydrocarbyl substituents with unsaturated carboxylic acylating agents, such as itaconic, citraconic, or maleic acylating agents at a temperature of 160°, or 185° C. up to 240° C., or to 210° C. Maleic acylating agents are the preferred unsaturated, acylating agent. The procedures for preparing the acylating agents are well known to those skilled in the art and have been described for example in U.S. Pat. No. 3,412,111.

The amine which reacts with the succinic acylating agent can be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

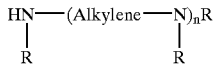

wherein n has an average value from 1 or 2 to 10, or 7, or 5, and the "Alkylene" group has from 1 or 2 to 10, or 6, or 4 carbon atoms. Preferred polyamine contain 2 to 10 amino groups per molecule. Each R is independently hydrogen, or an aliphatic or hydroxy-substituted aliphatic group of up to 30 carbon atoms. Such alkylenepolyamines include methylenepolyamines, ethylenepolyamines, butylenepolyamines, propylenepolyamines, pentylenepolyamines, etc. Ethylenepolyamine, also referred to as polyethyleneamine, is preferred. Such polyamines are most conveniently prepared by the reaction of ethylene dichloride with ammonia or by reaction of an ethylene imine with a ring opening reagent such as water, ammonia, etc.

The reaction products of hydrocarbyl-substituted succinic acylating agents and amines and methods for preparing the same are described for example in U.S. Pat. Nos. 4,234,435; 4,952,328; 4,938,881; 4,957,649; and 4,904,401.

A preferred nitrogen-containing dispersant is the reaction product of polyisobutylene-substituted succinic anhydride with at least one polyethyleneamine. Other nitrogen-containing dispersants are known and include, for example, Mannich dispersants. These are materials which are formed by the condensation of a higher molecular weight, alkyl substituted phenol, an alkylene polyamine, and an aldehyde such as formaldehyde. Such materials may have the general structure

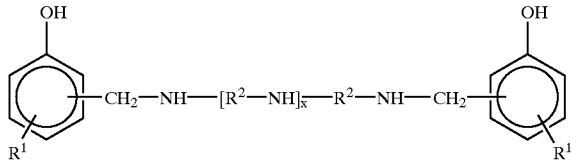

(including a variety of isomers and the like) and are described in more detail in U.S. Pat. No. 3,634,515.

The nitrogen-containing dispersant, and in particular the acylated amine dispersant, can be in whole or in part a borated dispersant. Borated dispersants include, for example, the reaction product of the hydrocarbyl-substituted succinic acylating agent and the amine, described above, with a boron compound. Suitable boron compounds include boron oxide, boron oxide hydrate, boron acids such as, boronic acid (e.g. alkyl-$B(OH)_2$ or aryl-$B(OH)_2$, boric acid (i.e., $H_3BO3$) tetraboric acid (i.e., $H_2B_4O_7$), metaboric acid (i.e. $HBO_2$) and esters of such boron acids. Specific examples of boronic acids include methyl boronic acid, phenyl boronic acid, cyclohexyl boronic acid, p-heptylphenyl boronic acid, and dodecyl boronic acid.

The boron acid esters include especially mono-, di-, and tri-organic esters of boric acid with alcohols or phenols such as, e.g., methanol, ethanol, isopropanol, cyclohexanol, cyclopenitanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol, diethylene glycol, carbitol, Cellosolve™, triethylene glycol, tripropylene glycol, phenol, naphthol, p-butylphenol, o,p-diheptylphenol, n-cyclohexylphenol, 2,2-bis-(p-hydroxyphenyl)propane, polyisobutene (molecular weight of 1500)-substituted phenol, ethylenechlorhydrin, o-chlorophenol, m-nitrophenol, 6-bromooctanol, and 7-ketodecanol. Lower alcohols, 1,2-glycols, and 1,3-glycols, i.e., those having fewer than about 8 carbon atoms are specially useful for preparing the boric acid esters for the purpose of this invention. Most preferably the boron compound is boric acid.

The reaction of the acylated nitrogen compositions with the boron compounds can he effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture.

The reaction is usually complete within a short period such as 0.6 to 6 hours. After the reaction is complete, the product may be dissolved in the solvent and the resulting solution purified by centrifugation or filtration if it appears to be hazy or contain insoluble substances. Ordinarily the product is sufficiently pure that further purification is unnecessary or optional.

The relative proportions of the reactants to be used for preparation of the borated material are based primarily upon the consideration of utility of the products for the purposes of this invention. In this regard, useful products are obtained from reaction mixtures in which the reactants are present in relative proportions as to provide from about 0.1 atomic proportions boron for each mole of acylated nitrogen composition used to about 10 atomic proportions of boron for each atomic proportion of nitrogen of said acylated nitrogen composition used. The preferred amounts of reactants are such as to provide from about 0.5 atomic proportions of boron for each mole of the acylated nitrogen composition to about 2 atomic proportions of boron for each atomic proportion of nitrogen used. To illustrate, the amount of a boron compound having one boron atom per molecule to be used with one mole of any acylated nitrogen composition having five nitrogen atoms per molecule is within the range from about 0.1 to about 50 moles, preferably from about 0.5 to about 10 moles. It is preferred that the components are present in relative amounts of about 3–5 moles carbonyl group, about 2–8 moles amino group, and about 2–8 moles boric acid. It is more preferred that the relative amounts are about 3–5 moles carbonyl group, about 2–4 moles amino group, and about 2–4 moles boric acid. The preparation of such complexes is more fully described in U.S. Pat. No. 3,087,936.

When the boronated dispersant is present, it will normally be present along with a portion of non-borated nitrogen-containing dispersant. In certain embodiments the borated dispersant will comprise 5 to 50% by weight of the dispersant component, preferably 10 to 30%, and more preferably 15 to 20%. Thus in one embodiment, the amount of the nitrogen-containing dispersant is 1.5 to 6 percent by weight. This can comprise 1.3 to 5 percent non-borated dispersant and 0.1 to 1 percent borated dispersant. In another embodiment, where a borated dispersant is not used, the amount of nitrogen-containing dispersant can be 0.8 to 1.6 percent.

Another material which can be present is a sulfurized alkyl phenol detergent. Sulfurized alkyl phenols and the methods of preparing them are known in the art and are disclosed, for example, in greater detail in British Patent 2,062,672. In general, sulfurized alkyl phenols can be prepared by reacting an alkyl phenol with a sulfurizing agent such as elemental sulfur, a sulfur halide (e.g., sulfur monochloride or sulfur dichloride), a mixture of hydrogen sulfide and sulfur dioxide, or the like. The preferred sulfurizing agents are sulfur and the sulfur halides, and especially the sulfur chlorides, with sulfur dichloride ($SCl_2$) being especially preferred. The alkyl phenols which are sulfurized are generally compounds containing at least one (normally one) hydroxy group and at least one (normally one) alkyl radical attached to the same aromatic ring. The alkyl radical ordinarily contains 3–100, and preferably 6–20 carbon atoms. Illustrative phenols are n-propylphenol, isopropyl phenol, n-butylphenol, t-butyl phenol, hexylphenol, heptylphenol, octylphenol, n-dodecylphenol, (propene tetramer)-substituted phenol, octadecyl phenol, eicosylphenol, polybutene (m.w. 1000) phenol, n-dodecylresorcinol, and 2,5-di-t-butylphenol. Also included are methyl-bridged alkylphenols which may be prepared by reaction of an alkylphenol with a formaldehyde source. A preferred material is the reaction product of 1000 parts by weight tetrapropene-substituted phenol with 290 parts by weight sulfur dichloride.

The sulfurized alkyl phenol can be prepared by reacting the alkyl phenol with the sulfurizing agent over a period of e.g. 4 hours at 100–250° C. (e.g., 140° C.) in an inert diluent, followed by removal of acidic materials such as hydrogen halides by vacuum stripping or blowing with an inert gas such as nitrogen.

The sulfurized phenol detergent can be a so-called "ashless" detergent, meaning that the phenol functionality is not neutralized with a metal base. The distinction of ash-containing versus ashless is not particularly critical once the component has been blended into a formulation, since it is believed that other metals present in the formulation may to some extent mix among the various potential anions which may be present. However, if an ash-containing sulfurized phenol detergent is employed, it is important that the total sulfated ash content of the composition be maintained within the ranges set forth above.

The amount of the sulfurized alkyl phenol, if present, is typically 0.1 to 1.0 percent by weight of the composition, preferably 0.2 to 0.5 percent.

Another component which may be present is a metal salt of a dihydrocarbyl dithiophosphoric acid (a metal dithiophosphate) wherein (1) the dithiophosphoric acid is prepared by reacting phosphorus pentasulfide with an alcohol mixture comprising at least 10 mole percent of isopropyl alcohol and at least one primary alcohol containing 3 to 13 carbon atoms, and (2) the metal is a Group II metal, aluminum, tin, iron, cobalt, lead, molybdenum, manganese, nickel, or copper.

The phosphorodithioic acids from which the metal salts useful in this invention are prepared are obtained by the reaction of about 4 moles of an alcohol mixture per mole of phosphorus pentasulfide, and the reaction may be carried out within a temperature range of 50° to 200° C. The reaction generally is completed in 1 to 10 hours, and hydrogen sulfide is liberated during the reaction.

The alcohol mixture which is typically utilized in the preparation of the dithiophosphoric acids useful in this invention comprise a mixture of isopropyl alcohol and at least one primary aliphatic alcohol containing 3 to 13 carbon atoms. In particular, the alcohol mixture will contain at least 10 mole percent of isopropyl alcohol and will generally comprise 20 to 90 mole percent isopropyl alcohol. In one preferred embodiment, the alcohol mixture will comprise 40 to 60 mole percent isopropyl alcohol, the remainder being one or more primary aliphatic alcohols.

The primary alcohols which may be included in the alcohol mixture include n-butyl alcohol, isobutyl alcohol, n-amyl alcohol, isoamyl alcohol, n-hexyl alcohol, 2-ethyl-1-hexyl alcohol, isooctyl alcohol, nonyl alcohol, decyl alcohol, dodecyl alcohol, tridecyl alcohol, etc. The primary alcohols also may contain various substituent groups such as halogens. Particular examples of useful mixtures include, for example, isopropyl/n-butyl; isopropyl/secondary butyl; isopropyl/2-ethyl-1-hexyl; isopropyl/isooctyl; isopropyl/decyl; isopropyl/dodecyl, and isopropyl/tridecyl.

The composition of the phosphorodithioic acid obtained by the reaction of a mixture of alcohols (e.g. iPrOH and $R^2OH$) with phosphorus pentasulfide is actually a statistical mixture of three or more phosphorodithioic acids as illustrated by the following formulas:

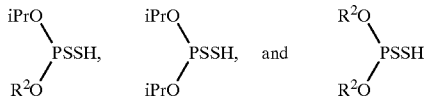

In the present invention it is preferred to select the amount of the alcohols reacted with the $P_2S_5$ to result in a mixture in which the predominating dithiophosphoric acid is the acid (or acids) containing one isopropyl group and one primary alkyl group. Relative amounts of the three phosphorodithioic acids in the statistical mixture is dependent, in part, on the relative amounts of the alcohols in the mixture, steric effects, etc.

The preparation of the metal salt of the dithiophosphoric acids may be effected by reaction with the metal or metal oxide. Simply mixing and heating these two reactants is sufficient to cause the reaction to take place and the resulting product is sufficiently pure for the purposes of this invention. Typically the formation of the salt is carried out in the presence of a diluent such as an alcohol, water, or diluent oil. Neutral salts are prepared by reacting one equivalent of metal oxide or hydroxide with one equivalent of the acid.

The metal salts of dihydrocarbyl dithiophosphoric acids which are useful in this invention include those salts containing Group II metals, aluminum, lead, tin, molybdenum, manganese, cobalt, and nickel. Zinc and copper, particularly zinc, are especially useful metals. Examples of metal compounds which may be reacted with the acid include silver oxide, silver carbonate, magnesium oxide, magnesium hydroxide, magnesium carbonate, magnesium ethylate, calcium oxide, calcium hydroxide, zinc oxide, zinc hydroxide, strontium oxide, strontium hydroxide, cadmium oxide, cadmium carbonate, barium oxide, barium hydrate, aluminum oxide, aluminum propylate, iron carbonate, copper hydroxide, lead oxide, tin butylate, cobalt oxide, nickel hydroxide, etc.

In some instances the incorporation of certain ingredients such as small amounts of the metal reactant will facilitate the reaction and result in an improved product. For example, the use of up to about 5% of zinc acetate in combination with the required amount of zinc oxide facilitates the formation of a zinc phosphorodithioate.

Further information about these materials and examples of their preparation are found in U.S. Pat. No. 4,981,602.

The amount of the metal dithiophosphate, if present, is typically 0.05 to 1, preferably 0.1 to 0.5, percent by weight of the composition. In a preferred composition, the metal dithiophosphate will be present in an amount suitable to provide a fully formulated lubricant composition containing less than 0.1 percent by weight phosphorus, preferably 0.01 to 0.07 percent by weight phosphorus, and more preferably 0.02 to 0.04 percent by weight. In another preferred composition, the metal dithiophosphate will be a zinc dithiophosphate and will be present in an amount suitable to provide to the fully formulated lubricant containing less than 0.1 or 0.12 percent by weight zinc, preferably 0.01 to 0.09 percent by weight zinc, and more preferably 0.02 to 0.05 percent by weight.

Other materials can also be present, in amounts effective to perform their intended functions. Examples include metal deactivators, anti-foam agents, antiwear agents, extreme pressure agents, antirust agents, and vapor phase antirust-demulsifiers. Metal deactivators are generally materials which complex with metals, including ethylenediamine tetraacetic acid, N,N-disalicylidene-1,2-propanediamine, tolyltriazole, and the reaction product of dimercaptothiadiazole (DMTD) with alkylmercaptans, as described in greater detail in U.S. Pat. No. 948,523. This latter material is believed to have a structure

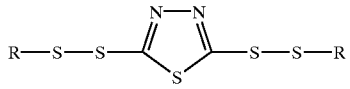

where R is typically $C_{9-12}$, especially $C_9$, alkyl. Typically the amount of metal deactivator employed will be 0.05 to 0.3 percent by weight.

Antifoam agents include polyacrylates and, in particular, polysiloxanes. They will typically be employed at 10–500 parts per million.

The compositions of the present invention can be prepared, as described in detail above, as fully formulated products. Alternatively, they can be prepared as concentrates, in which the amount of oil is reduced to an amount sufficient to prepare a concentrate and to aid in easy handling of the resulting composition. In a concentrate the amount of oil is, as described above, up to 50%, e.g., 1 to 50%, preferably 3 to 30% and more preferably 5 to 20%. The amounts of the other components are increased proportionally, and will be present in an amount suitable to provided a total sulfated ash within the limits set forth above when the concentrate is diluted to form a final formulation. For purposes of comparison, this can be said to be dilution in a way such that components (b) (the calcium overbased acid), (c) (the magnesium overbased acid), (d) (the phenol antioxidant), and (e) (the other antioxidant) together comprise 3.5 percent by weight of the diluted composition. A typical concentrate will comprise (a) a concentrate-forming amount of an oil of lubricating viscosity; (b) 1 to 30 parts by weight of a calcium overbased acidic material; (c) 1 to 20 parts by weight of a magnesium overbased acidic material; (d) 1 to 15 parts by weight of an alkylene-coupled hindered phenol antioxidant; (e) 1 to 60 parts by weight of at least one antioxidant other than an alkylene-coupled hindered phenol antioxidant; provided that components (d) and (e) together comprise at least about 5 parts by weight of the concentrate, and (f) at least 2 parts by weight of a dispersant. Other components, listed in detail above, can be included as desired.

The materials of the present invention can also include other additives which may prove useful for the particular purpose at hand. However, in distinction from what may be superficially, similar compositions, the present compositions can, if desired, be formulated to be entirely free or substantially free from such additives as emulsifiers, demulsifiers, gelling agents, extreme-pressure/antiwear agents including zinc and phosphorus containing materials such as zinc dithiophosphates, other sources of phosphorus, sources of heavy metals, sources of chlorine or other halogens, sulfurized organic compounds, friction modifiers including fatty acids, pour point depressants such as alkylated naphthalenes, cloud point depressants, and seal swell agents. By "substantially free" is meant that the amount of the material in question is so low that the presence of the material has no significant or practical effect on the performance of the composition. A composition can be "substantially free" from a substance if the substance is present in only a trace amount.

The compositions of the present invention are employed in practice as lubricants by supplying the lubricant to an internal combustion engine (such as a stationary gas-powered internal combustion engine) in such a way that during the course of operation of the engine the lubricant is delivered to the critical parts of the engine, thereby lubricating the engine.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) heteto substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

EXAMPLES

Example 1

A lubricating composition is prepared by combining the following ingredients:

| | |
|---|---|
| 91.9% | Lubricating Oil (predominantly 600 Neutral oil, SAE 40, including small amounts of diluents oils from other listed components) |
| 3.3% | Low molecular weight succinimide dispersant derived from polyisobutenyl (m.w. about 900) succinic anhydride and an amine mixture of about 4 parts amine bottoms and about 1 part diethylenetriamine, the product having a ratio of 4 carbonyl groups:3 N atoms. |
| 0.47% | Borated low molecular weight polyisobutenyl (m.w. about 900) succinimide dispersant based on the same amine mixture, containing 1.8 weight percent boron (CO:N:B = 1:2:2) |
| 0.91% | Mg overbased carbonated synthetic sulfonate (alkyl benzenesulfonate) molecular weight about 500, 153 TBN (oil-free basis) |
| 0.72 | Ca overbased carbonated $C_{16}$ alkyl salicylate |
| 1.32% | Dinonyl diphenyl amine |
| 0.50% | 4,4'-methylene bis(2,6.-di-t-butyl phenol) |
| 0.75% | Dodecyl 2,6-di-t-butyl phenol |
| 0.12% | Dimercaptothiadiazole/$C_9$ alkylmercaptan product |
| 80 ppm | Silicone antifoam agent |

The above composition is supplied to lubricate a stationary gas internal combustion engine.

Example 2

A lubricating composition is prepared by combining the following ingredients:

| | |
|---|---|
| 94.9% | Lubricating Oil (predominantly 600 Neutral oil, SAE 40, including small amounts of diluents oils from other listed components) |
| 1.33% | Low molecular weight succinimide dispersant from polybutenyl (m.w. about 900) succinic anhydride and polyamines condensed with trimethylolpropane. |
| 0.46% | Sulfurized tetrapropene substituted phenol, coupled with 3 S atoms per 4 phenol groups |
| 0.26% | Ca overbased carbonated synthetic sulfonate, 508 TBN (oil-free basis) (also contains polybutenyl succinic anhydride stabilizer, 0.02% based on total composition) |
| 0.71% | Mg overbased carbonated synthetic sulfonate (alkyl benzenesulfonate, molecular weight about 500), 153 TBN (oil-free basis) |

-continued

| | |
|---|---|
| 0.27% | Zinc isobutyl/l-amyl (65:35 mole ratio)dithiophosphate |
| 1.32% | Dinonyl diphenyl amine |
| 0.50% | 4,4'-methylene bis(2,6-di-t-butyl phenol) |
| 0.60% | Dodecyl 2,6-di-t-butyl phenol |
| 0.12% | Dimercaptothiadiazole/$C_9$ alkylmercaptan product |
| 60 ppm | Silicone antifoam agent |

The above composition is supplied to lubricate a stationary gas internal combustion engine.

Example 3

A lubricating composition is prepared by combining the following ingredients:

| | |
|---|---|
| 94.8% | Lubricating Oil as in example 1 |
| 0.4% | Calcium overbased carbonated synthetic sulfonate (alkyl benzenesulfonate, molecular weight about 500) 153 TBN (oil-free basis) |
| 0.8% | Magnesium overbased mixed alkyl $C_{12-18}$ salicylates, 150 TBN |
| 2.4% | Low molecular weight succinimide dispersant as in Ex. 1 |
| 0.4% | 4,4'-methylene bis(2,6-di-t-butyl phenol) |
| 1.0% | dodecyl-2,5-di-t-butyl phenol |
| 0.2% | Tolyltriazole |

The above composition is supplied to lubricate a stationary gas internal combustion engine.

Example 4

A concentrate for a lubricating composition is prepared by combining the following ingredients:

| | |
|---|---|
| 39% | Lubricating Oil as in example 1 |
| 14% | Barium synthetic sulfonate (alkyl benzene sulfonate, molecular weight about 500) 400 TBN (oil free) |
| 8% | Sodium synthetic sulfonate (alkyl benzene sulfonate, molecular weight about 500) 150 TBN (oil free) |
| 6% | Succinimide dispersant, m.w. about 1200 4,4'-ethylidene bis(2,6-di-t-butyl phenol) |
| 15% | di-nonyl-diphenylamine |
| 10% | Tolyltriazole |

The above composition is diluted with additional lubricating oil and supplied to lubricate a stationary gas internal combustion engine.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A composition comprising:

(a) a major amount of an oil of lubricating viscosity;

(b) a calcium, barium, or strontium overbased acidic material in an amount to contribute 0.01 to 0.79 percent sulfated ash;

(c) a magnesium or sodium overbased acidic material in an amount to contribute 0.01 to 0.79 percent sulfated ash;

(d) about 0.1 to about 1.5 percent by weight of an alkylene-coupled hindered phenol antioxidant;

(e) about 0.1 to about 6 percent by weight of at least one aromatic amine antioxidant; provided that components (d) and (e) together comprise at least about 0.5 percent by weight of the composition; and (f) at least about 0.2 percent by weight of a dispersant; further provided that the composition has a total sulfated ash content of about 0.1 percent to about 0.8 percent.

2. The composition of claim 1 wherein the calcium, barium, or strontium overbased acidic material is a calcium overbased sulfonic acid, substituted salicylic acid, or substituted phenol.

3. The composition of claim 1 wherein the magnesium or sodium overbased acid material is a magnesium overbased sulfonic acid, substituted salicylic acid, or substituted phenol.

4. The composition of claim 1 wherein the alkylene-coupled hindered phenol antioxidant is methylene-coupled 2-6-di-t-butylphenol.

5. The composition of claim 1 wherein the dispersant (f) is about 0.5 to about 10 percent by weight of a condensation product of polyethyleneamines with polyisobutylsuccinic anhydride, the polyethyleneamines having about 2 to about 10 amino groups per molecule and the polyisobutyl group having a number average molecular weight of about 500 to about 5000.

6. The composition of claim 5 wherein a portion of the dispersant is a borated dispersant.

7. The composition of claim 1 further comprising at least one of (g) about 0.1 to about 1.0 percent by weight sulfurized alkyl phenol detergent and (h) about 0.05 to about 1 percent by weight of a metal dialkyldithiophosphate.

8. The composition of claim 1 wherein the amount of the calcium, barium, or strontium overbased acidic material is about 0.1 to about 3.0 percent by weight.

9. The composition of claim 1 wherein the amount of the magnesium or sodium overbased acidic material is about 0.01 to about 2.0 percent by weight.

10. A method for lubricating a gas-powered internal combustion engine, comprising supplying to the engine the composition of claim 1.

11. A composition comprising (a) a concentrate-forming amount of an oil of lubricating viscosity;

(b) a calcium, barium, or strontium overbased acidic material;

(c) a magnesium or sodium overbased acidic material;

(d) about 1 to about 15 parts by weight of an alkylene-coupled hindered phenol antioxidant;

(e) about 1 to about 60 parts by weight of at least one aromatic amine antioxidant; provided that components (d) and (e) together comprise at least about 5 parts by weight; and (f) at least about 2 parts by weight of a dispersant; provided that the composition has a metal content suitable to provide a total sulfated ash of about 0.1 percent to about 0.8 percent, 0.01 to 0.79 percent sulfated ash being contributed by the material of (b) and 0.01 to 0.79 percent being contributed by the material of (c), when the composition is diluted in a way that components (b), (c), (d), and (e) together comprise 3.5 percent by weight of the diluted composition.

12. The composition of claim 11 wherein the amount of the oil of lubricating viscosity is about 1 to about 50 percent by weight of the composition.

* * * * *